United States Patent [19]

Aujla

[11] Patent Number: 4,530,553

[45] Date of Patent: Jul. 23, 1985

[54] MINIMUM INSERTION FORCE CONNECTOR

[75] Inventor: Sharanjit S. Aujla, Kanata, Canada

[73] Assignee: Northern Telecom Limited, Montreal, Canada

[21] Appl. No.: 589,762

[22] Filed: Mar. 15, 1984

[51] Int. Cl.[3] ..... H01R 13/631

[52] U.S. Cl. ..... 339/17 LC; 339/75 M

[58] Field of Search ..... 339/17 LC, 75 R, 75 M, 339/75 MP, 91 R, 217 S, 258 R, 258 P

[56] References Cited

U.S. PATENT DOCUMENTS

| | | | |
|---|---|---|---|
| 3,268,851 | 8/1966 | Mancini | 339/238 R |
| 3,474,387 | 10/1969 | Krum et al. | 339/75 MP |
| 3,720,907 | 3/1973 | Asick | 339/258 R |
| 3,862,792 | 1/1975 | Jayne | 339/258 R |
| 3,883,207 | 5/1975 | Tomkiewicz | 339/75 M |
| 3,912,353 | 10/1975 | Kasuya et al. | 339/75 MP |
| 3,989,331 | 11/1976 | Hanlon | 339/258 R |
| 4,108,522 | 8/1978 | Favale | 339/91 R |

FOREIGN PATENT DOCUMENTS

| | | | |
|---|---|---|---|
| 2350834 | 4/1975 | Fed. Rep. of Germany | 339/258 R |
| 397029 | 2/1966 | Switzerland | 339/217 S |

*Primary Examiner*—John McQuade

*Attorney, Agent, or Firm*—Sidney T. Jelly

[57] ABSTRACT

A connector has socket-type terminals, each terminal having a main body part from the front end of which two arms project, as cantilevers. The inner part of each arm is curved, generally arcuate, and the outer part of each arm extends generally straight and inclined away from each other. A contact position is formed at the junction between the inner and outer part. Such terminals are housed in slots in a plug and a receptacle has pins which are inserted into the terminals. Cam surfaces on the receptacle engage with the free ends of the arms after partial insertion of the pins and press the arms together, pushing the contact positions into contact with the pins. A low insertion force is obtained.

17 Claims, 9 Drawing Figures

MINIMUM INSERTION FORCE CONNECTOR

This invention relates to socket-type terminals, which accept pin and similar type terminals, particularly as are used in telecommunications systems to interconnect circuit boards, connect circuit boards to backplanes, and similar arrangements.

The developments in silicon technology have resulted in an increase in the density of integrated circuits, an increase in the speed of signal transmission, and an increase in functionality of devices. This in turn has created stringent requirements in the interconnection field to provide connectors with a small size, a high number of contacts and a low mating or insertion force. However these requirements are contradictory and connectors with more than two hundred terminals have been marginal in performance, and in fact connectors with less than two hundred terminals often do not give adequate or acceptable performance. This is because of various factors, such as:

(i) the contact normal force required to provide and maintain a reliable connection has been sacrificed in order to provide a low insertion force;

(ii) connectors providing zero, or very low, insertion forces have been very complex and expensive;

(iii) the relatively large size has not been conducive to either dense packaging or package size reduction.

By contact normal force is meant the force exerted between two contacting surfaces in a direction normal to the contact plane.

The present invention provides a terminal which can be arranged to give a minimal insertion force, down to as low as zero, but which is arranged to produce a high contact normal force once a mating terminal has been inserted. The terminal, which for convenience is referred to as the socket terminal has a main body part for positioning in a connector part, and two cantilever arms extending from one end of the main body part. The cantilever arms each comprise two portions, an inner portion attached at an inner end to the main body part, and an outer portion attached at an inner end to the outer end of the inner portion. The inner portion extends in a curve having a convex outer surface and a concave inner surface. The concave surfaces of the inner portions of the two arms are in opposition. The outer portion is normally straight and is aligned with the inner portion. The two outer portions of the two arms normally incline away from each other at a slight angle. The junctions between the inner and outer portions of the arms form contact areas or positions. In use, after the initial insertion of a male terminal into the socket terminal, with the male terminal having entered past the contact areas or positions, the arms are deformed inwards towards each other by cam members acting on the outer ends of the cantilever arms. This forces the contact areas or positions into contact with the male terminal.

The terminals of the invention can be mounted in connector members at a very small pitch, and provide a high density low insertion force connector. In particular the female terminals are mounted in one connector part and the male terminals mounted in another connector part, and the cam members are formations on the connector part having the male terminals.

The invention will be readily understood by the following description of one form of terminal and a connector embodying the terminal, by way of example, in conjunction with the accompanying drawings, in which.

Figure 1:
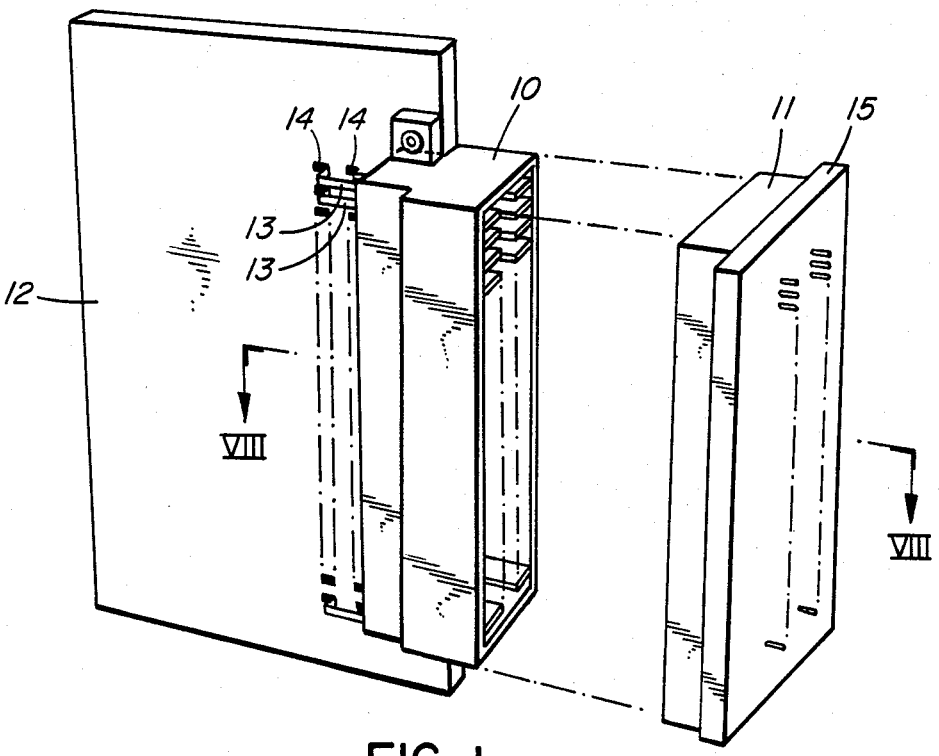
FIG. 1 is an exploded perspective view of one form of connector.

FIG. 1 illustrates a connector having a plug 10 containing socket terminals, not seen, and a receptacle 11 containing pin terminals (also not seen). The plug and receptacle are conveniently of molded plastic. The plug has, in the example, two rows of slots or recesses in which are positioned the socket terminals. In the example, in FIG. 1, a circuit board 12 is attached to the plug 10 and tail ends of the socket terminals, indicated at 13 are connected, as by soldering to contact areas 14 on the circuit board. The receptacle 11 is shown attached to a backplane or other circuit board 15. The plug and receptacle will be described further with respect to FIGS. 8 and 9.

Figure 2:
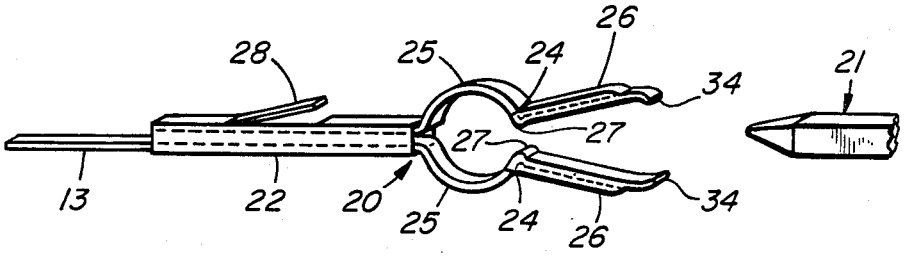
FIG. 2 is a perspective view of a socket terminal in accordance with the invention, together with a square pin terminal prior to insertion.
Figure 3:
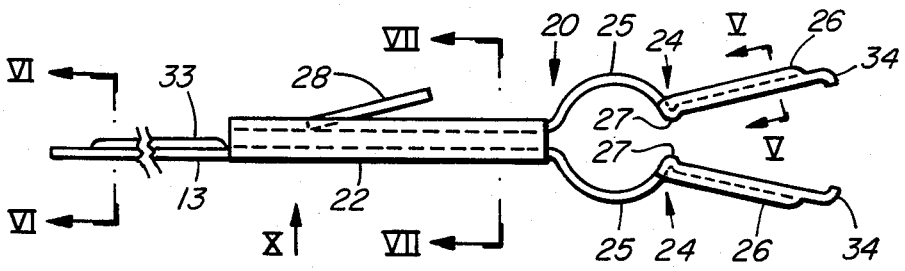
FIGS. 3 and 4 are side and plan views respectively of the terminal of FIG. 2, FIG. 4 being in the direction of arrow X in FIG. 3.

FIG. 2 illustrates the combination of a socket terminal 20 and a square pin terminal 21. The socket terminal 20 has a main body part 22 with the tail portion 13 extending from a rear end. From the front end of the body part 22 extend two arms 24. The two arms each have an inner curved portion 25 and an outer substantially straight portion 26. At the junctions of the curved and straight portions are formed contact areas or positions 27. A tab 28 on the body part 22 retains the socket terminal in the plug once it is in position. The distance between the contact positions 27 is normally made equal to or slightly greater than the dimension of the pin terminal 21 which will be between the contact positions 27. While a square pin has been illustrated, pins of other cross-sections can be used, for example, round, oval, flat and the like.

Figure 4:
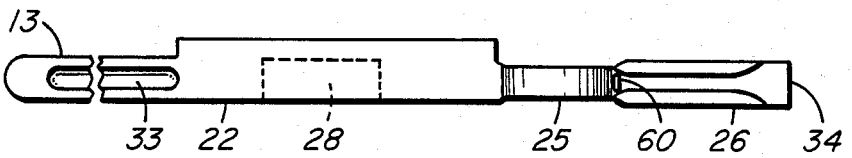
Figure 5:
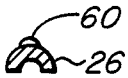
FIGS. 5, 6 and 7 are cross-sections on the lines V—V, VI—VI and VII—VII respectively of FIG. 3.
Figure 6:
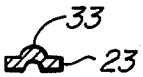
Figure 7:
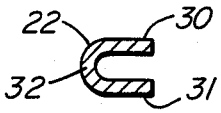

The socket terminal 20 is seen in more detail in FIGS. 3 to 7. The main body part 22 is of a U-shaped or channel shaped cross-section, as seen in FIG. 7, having upper and lower webs 30 and 31, joined by section 32, in the example, section 32 being arcuate. At the outer end of the body part the webs 30 and 31 extend to form the arms 24. The inner portions of the arms, at 25, are formed into arcs having a common center. The portions 25 each extend for a substantial part of a semi-circle, with the outer ends of portions 25 connected to the inner ends of the outer portions 26. The cross-section of the portions 25 is rectangular, being wider than its thickness, and is flexible. The straight outer portions 26 are of arcuate cross-section, as seen in FIG. 5, to provide a high degree of stiffness. The tail portion 23 is also stiffened by forming a longitudinally extending rib 33. At the outer ends the portions 26 are curved inwards, at 34, to form entry ramps as will be discussed later.

The socket terminal is readily formed from strip material, first blanked and then bent at the body part 22 to form the body part and the arms. One or more intermediate forming stages may be necessary to form the arms 24 and the rib 33. The tab 28 can also be formed by shearing out a section of the body part.

Figure 8:
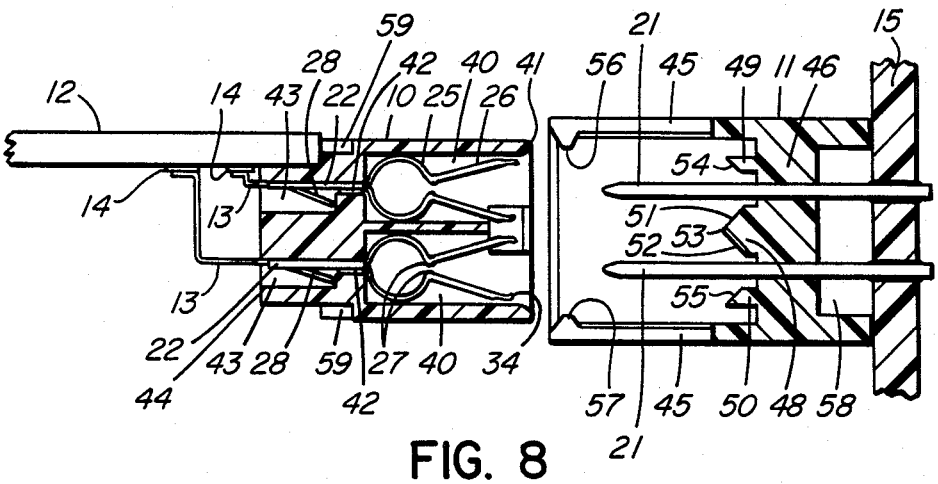
FIG. 8 is a cross-section, as on the line VIII—VIII of FIG. 1, illustrating a connector with terminals as in FIGS. 2 to 7.
Figure 9:
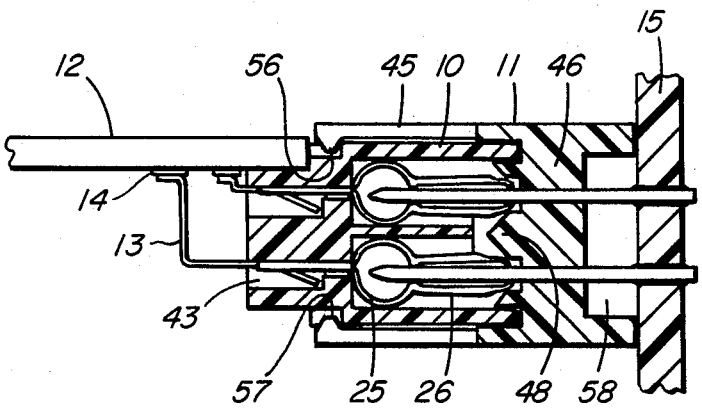
FIG. 9 is a cross-section similar to that of FIG. 8, with the connector parts assembled.

FIG. 8 illustrates the two mating parts of a connector, in cross-section, prior to assembly together. The plug 10 has two rows of slots or recesses 40 extending in from a front face 41. Apertures 42 extend from the back surfaces of the slots or recesses through the remainder of the plug, with an enlarged section or recess 43 extending in from the rear face 44. A socket terminal is positioned in each slot or recess, the slot or recess containing the curved portions 25 and straight portions 26 with the body portions 22 extending through the apertures 42. The tabs 28 extend into the recesses 43 and retain the socket terminals in position. The tail portions 13 are bent down to be soldered to the contact areas 14. The tail portions can be made with different lengths, or can be cropped after insertion of the terminals into the plug. The terminals are inserted in from the front face 41, the tabs 28 being depressed as they pass through the forward part of each aperture 42, snapping out into the recesses 43 when the terminals are fully inserted. Depending upon requirements, only a single row of slots or recesses 40, or more than two rows of slots or recesses can be provided.

The receptacle 11 has two rows of pin terminals 21. In the example the pin terminals are inserted through the back plane or circuit board 15, and soldered with their forward ends projecting through the receptacle 11 attached to the board 15 and connected to a circuit pattern. The receptacle has a hollow box-like formation with spaced top and bottom walls 45 at the front portion. A transverse rear wall 46 holds the pins in position. On the front surface of the wall 46 is a central rib 48 and two side ribs 49 and 50. The central rib has two outwardly and rearwardly inclined cam surfaces 51 and 52 extending from an apex 53. The side ribs having their front surfaces inclined rearward and inward towards the central rib, as illustrated at 54 and 55, to form further cam surfaces. The forward ends of the top and bottom walls have inwardly extending ribs 56 and 57 extending along each wall. The rear face of the wall 46 can be recessed, as at 58. To ease insertion of the plug 10 into the receptacle 11, the walls 45 can be subdivided into sections, for ease in deforming of the walls during insertion.

The walls 45 are spaced apart to be a sliding fit over the plug 10. The ribs 56 and 57 are positioned such that on full assembly of plug and receptacle, the ribs snap into recesses 59 towards the back of the plug 10. As the plug and receptacle are pushed together, the forward ends of the pins 21 pass between the straight portions 26 of the arms and eventually enter between the contact positions 27. Once the ends of the pins have passed between the contact positions, the ramp surfaces 51, 52, 54 and 55 move into contact with the curved ends 34 of the arms. Continued movement of plug and receptacle together causes the cam surfaces to push the straight portions of the arms inward. This moves the contact positions into contact with the pin. Continued pushing on the arms distorts the curved portions 25 and increases the contact force between the contact positions 27 and the pins 21. A wiping action also occurs, to give good contact conditions.

Thus, on initial insertion there is no insertion load arising from contact between pin terminal and socket terminal. One of the major effects in a conventional terminal arrangement is the pushing apart of spring contact members of the socket terminal by the end of the pin terminal, on initial insertion. In the present invention this is avoided. The design results in a relatively high contact normal force with a lower force at the ramp surfaces. As an example, a contact normal force or load of 100 grams at the contact positions can be obtained with a 37 gram force or load at the cam surfaces. This proportion can be varied, and the actual values varied, by variation of the design. As with the plug, the number of rows of pin terminals can be varied, from 1 row to several rows.

The operation of the arms can be varied by variation in the design, such as the size, shape and material thickness of various parts. While the curved portions 25 have been illustrated and described as being arcs, the curved portions could be of other forms. For example, instead of a circular appearance when two arms are opposed, as in FIG. 3, this could be oval. The clearance between the curved portion outer surface and the inner surfaces of the slots or recesses 40 will also modify operation, as once contact occurs between the curved portions and the slot walls, the deformation characteristics of the curved portions 25 will change. The length of the straight portions, and particularly the relationship between the length of the straight portions and the chordal length of the curved portions, will also affect the relationship between the loads or forces at the ramp surfaces and the load or force on the pin at the contact position.

To improve contact conditions at the contact positions 27, the material can be dimpled, as indicated at 60 in FIG. 4, to give a more rounded form to the contact position. Gold plating or other conventional contact treatment practices can be applied to the contact positions.

The angles of the cam surfaces 51, 52, 54 and 55 can vary and can also be profiled, for example curved instead of straight. It is possible to arrange that the ramps or cam surfaces 51, 52, 54 and 55 do not contact all the curved ends 34 at the same time, but provide some progressive inter-engagement.

Advantages over conventional socket terminals and differences in form are numerous and include:

- utilization of curved flexible beams for optimum spring properties as opposed to straight cantilever beams;
- the pin terminals experience zero insertion force initially instead of having to overcome a preload to enter the socket terminal;
- the socket contacts can accept round, square and blade type pin terminals;
- the small size of the socket terminal provides a high density connector;
- a low insertion force is obtained while maintaining a high contact normal force contrary to conventional terminals where a lower insertion force is obtained at the sacrifice of contact normal force, affecting reliability;
- contact wipe is obtained, achieving a high quality initial connection;
- the self-actuating mechanism of cam surfaces on the receptacle avoids use of complex cams and levers; and
- a connector with a high number of contacts can readily be provided.

What is claimed is:

1. A connector comprising a plug and a receptacle, said plug comprising a housing having at least one row of socket terminals positioned in the housing, each of said socket terminals comprising a main body part having a front end and a rear end; two arms extending from said front end, each arm having an inner curved portion and a substantially straight outer portion, the curved portions extending initially away from each other and curving round and towards each other, a contact position at each junction of a curved inner portion with an outer portion, and means for connecting a conductor to the socket terminal; said receptacle comprising a member interengaging with said housing of said plug, said member having at least one row of pin terminals, a pin terminal for each of said socket terminals, and cam surfaces on said member positioned to engage with the outer ends of said straight outer portions of said socket terminals, said pin terminals extending beyond said cam surfaces; the arrangement such that on initial interengagement of plug and receptacle, the inner ends of said pin terminals pass between the contact positions on said arms, continued interengagement of said plug and receptacle moving said cam surfaces into contact with said outer ends of said straight portions of said arms and pushing said front ends inward to move said contact positions into contact with said pin terminals.

2. A connector as claimed in claim 1, said means for connecting a conductor to the socket terminal comprising a tail extending from the rear end of the main body part.

3. A connector as claimed in claim 1, said main body part of hollow construction.

4. A connector as claimed in claim 1, said main body part having a channel shaped cross-section having upper and lower webs, said arms being extensions of said webs.

5. A connector as claimed in claim 1, said outer portions of said arms having an arcuate cross-section.

6. A connector as claimed in claim 1, said outer portions of said arms having inwardly curved ends.

7. A connector as claimed in claim 1, including a tab extending from said main body part at an intermediate position, said tab extending outwardly and forwardly.

8. A connector as claimed in claim 1, said inner curved portions of said arms extending in an arc.

9. A connector as claimed in claim 1, said outer portions of said arms extending outwardly and forwardly, away from each other.

10. A connector as claimed in claim 1, said contact positions at the junctions of the inner and outer portions of the arms being dimpled to form a rounded contact position.

11. A connector comprising a plug and a receptacle, the plug fitting in the receptacle, the plug comprising: a housing; at least one row of slots extending from a front face into the housing, spaced apart a predetermined position and extending parallel to each other, and an aperture extending from an inner end of each slot to a rear face; and a socket terminal positioned in each slot, each socket terminal comprising a main body part having a front end and a rear end; two arms extending from said front end, each arm having an inner curved portion and a substantially straight outer portion, the curved portions extending initially away from each other and curving round and towards each other; a contact position at each junction of a curved inner portion with an outer portion; a tail extending from the rear end of said main body part of each terminal, said tails extending through said apertures;

the receptacle comprising a hollow box-like form having top and bottom walls spaced to be a sliding fit over said plug; a transverse rear wall extending between said top and bottom walls; a plurality of pin terminals mounted in at least one row in said transverse rear wall and having forward ends positioned between said top and bottom walls, said pin terminals spaced to be aligned with said socket terminals; forwardly extending ribs on a front face of said transverse rear wall, a rib on each side of a row of said pin terminals, said ribs having inclined cam surfaces on inner ends thereof; the arrangement such that on initial insertion of the plug into the receptacle the inner ends of said pin terminals pass between the contact positions on said arms, continued insertion of said plug moving said inclined cam surfaces into contact with the front ends of said straight portions of said arms and pushing said front ends inward to move said contact positions into contact with said pin terminals.

12. A connector as claimed in claim 11, said receptacle mounted on a circuit board, said pin terminals connected to a circuit pattern on said board.

13. A connector as claimed in claim 11, including two rows of slots and associated socket terminals, and two rows of pin terminals mounted in said transverse rear wall of said receptacle.

14. A connector as claimed in claim 11, said housing of said plug including recesses in top and bottom surfaces, said recesses positioned towards the rear face of the housing, and projections on inner ends of said top and bottom walls of said receptacle, said projections extending inwards and snapped into said recesses in said top and bottom surfaces when said plug and said receptacle are in fully inserted condition.

15. A connector as claimed in claim 11, said outer portions of said arms of said socket terminals extending outwardly and forwardly away from each other, said contact positions at each terminal being separated initially by a distance at least equal to the corresponding dimension of a pin terminal.

16. A connector as claimed in claim 11, said pin terminals having a square cross-section.

17. A connector as claimed in claim 11, each of said apertures in said plug including an enlarged portion extending in from said rear face to form a recess, and a tab extending from the main body part of each terminal, the tabs extending into said recesses and retaining said terminals in position in said slots.

* * * * *